United States Patent [19]

Moldovan et al.

[11] Patent Number: 4,566,224

[45] Date of Patent: Jan. 28, 1986

[54] LAPPING APPARATUS

[75] Inventors: Anton G. Moldovan, E. Windsor Township, Mercer County; Randall E. McCoy, Willingboro Township, Burlington County, both of N.J.

[73] Assignee: RCA Corporation, Princeton, N.J.

[21] Appl. No.: 664,219

[22] Filed: Oct. 24, 1984

[51] Int. Cl.[4] ..... B24B 19/16

[52] U.S. Cl. ..... 51/56 R; 51/122; 51/124 R; 51/134.5 R; 51/165.77; 369/71

[58] Field of Search ..... 51/56 R, 110, 121, 122, 51/124 R, 134.5 R, 165.77, 283 R, DIG. 16; 369/71, 189

[56] References Cited

U.S. PATENT DOCUMENTS

| | | | |
|---|---|---|---|
| 2,404,282 | 7/1946 | Fruth | 51/124 R |
| 3,435,569 | 4/1969 | Stanley | 51/229 |
| 4,118,900 | 10/1978 | Moritomo et al. | 51/165.77 X |
| 4,165,560 | 8/1979 | Matsumoto | 29/630 R |
| 4,190,860 | 2/1980 | Somers et al. | 358/128.5 |
| 4,343,114 | 8/1982 | Tourasse et al. | 51/101 R X |
| 4,388,713 | 6/1983 | Tatsuguchi | 369/189 X |

FOREIGN PATENT DOCUMENTS

| | | | |
|---|---|---|---|
| 94103 | 6/1983 | Japan | 369/71 |

*Primary Examiner*—Robert P. Olszewski

*Attorney, Agent, or Firm*—Birgit E. Morris; Donald S. Cohen; James M. Trygg

[57] ABSTRACT

An improved lapping apparatus is disclosed of the type having a disc shaped lapping surface that rotates while a part to be lapped is held in engagement therewith. The improvement includes control apparatus for controlling the speed of rotation of the lap with respect to the radial position of the part on the lapping surface so that the surface speed of the lap relative to the part is held at a constant level as the part traverses the lapping surface.

4 Claims, 3 Drawing Figures

LAPPING APPARATUS

The present invention relates to the control of lapping apparatus of the type having a disc shaped lapping surface. Control is effected so that the relative speed between the part being lapped and the lapping surface is held constant.

BACKGROUND OF THE INVENTION

Apparatus for grinding facets on gem stones, diamond styli and other relatively hard materials typically include a disc shaped lap having an abrasive material disposed thereon. The disc is rotated by a motor and the part to be lapped, which is held in proper position by a holder, is urged into engagement with the spinning surface of the lap. The holder is made to oscillate or undergo other movement thereby causing the part to traverse a given portion of the lapping surface.

In one type of lapping machine the lapping surface is used only once. As the disc shaped lap turns, the part that is being lapped is advanced along a radial which emanates from the axis of rotation. The magnitude of the advancement is coordinated with the rotational speed of the lap so that the part always encounters an undisturbed portion of the lapping surface. It is customary, in this type of lapping machine to rotate the disc shaped lap at a constant angular velocity, approximately 250 RPM for a lap of about 14 inches in diameter. This speed was selected to achieve an acceptable over all cutting efficiency which is maximized at one point on the lapping surface. This, of course compromises cutting efficiency at other points on the lapping surface.

Such a compromise has little consequence in most lapping applications such as gem stone lapping. However, when lapping high precision parts such as diamond styli for video disc pickup applications the compromise is significant. Such diamond styli typically have a tip that is only about 2 micrometers wide and 4 micrometers long including several facets. The size and relative positioning of the facets are critical to proper performance of the finished stylus. Further, variable cutting efficiency, as the stylus progresses across the face of the lap, tends to frustrate the goal of repeatably producing finished styli within tolerance and of high quality utilizing automated equipment.

SUMMARY OF THE INVENTION

According to the present invention there is shown an improved lapping apparatus having a disc shaped lap journaled for rotation about an axis that is perpendicular to a lapping surface of the lap. A means is provided for rotating the disc shaped lap about this axis. A holder means is provided for positioning and holding a part to be lapped in contact with the lapping surface. Means is also provided for effecting movement of one of the holder means and the lap thereby causing the holder means to track a series of continuous positions with respect to the axis. This tracking occurs so that the part, while in contact with the lapping surface, traverses a portion of the lapping surface in either a direction toward the axis or a direction away from the axis. The improvement comprises a control means for effecting control of the means for rotating the lap so that the relative speed of the lapping surface with respect to the part is substantially constant while the part traverses the portion of lapping surface.

DESCRIPTION OF THE PREFERRED EMBODIMENT

Figure 1:
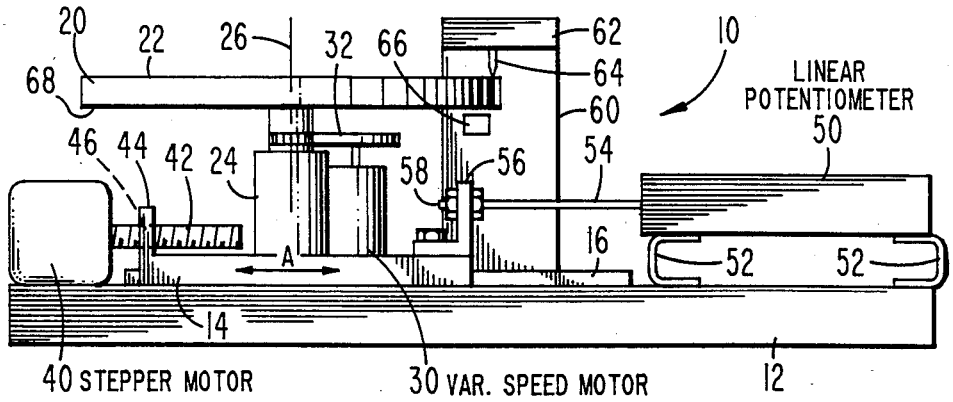
FIG. 1 is a front view of a lapping apparatus embodying the teachings of the present invention.
Figure 2:
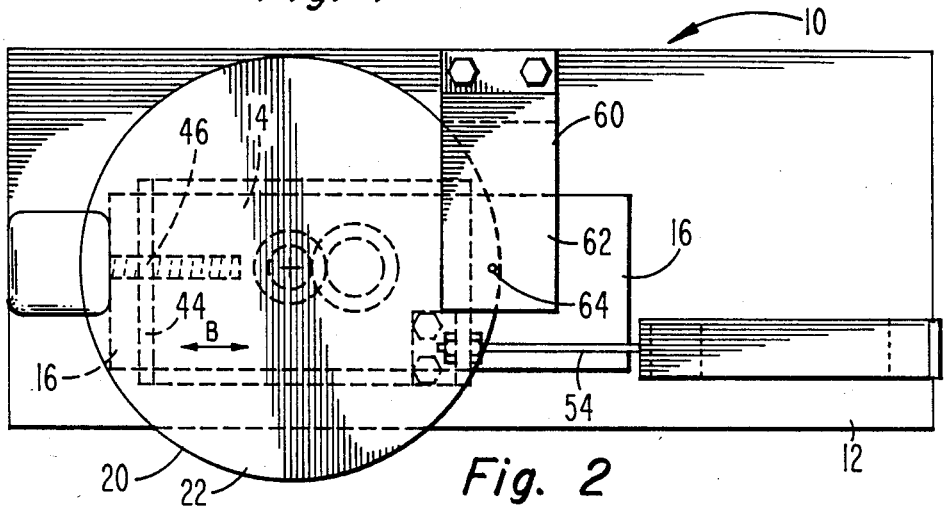
FIG. 2 is a top view of the apparatus shown in FIG. 1.

An improved lapping apparatus 10 is shown in FIGS. 1 and 2 having a base 12 and a support plate 14 which is slidingly attached to the base 12 by a slide 16. The support plate 14 is arranged to slide back and forth in the directions indicated by the arrows A and B in FIGS. 1 and 2 respectively. A disc shaped lap 20 having a flat lapping surface 22 is journaled for rotation in a boss 24 which is attached to the support plate 14. The axis of rotation 26 of the lap 20 is substantially perpendicular to the lapping surface 22.

A variable speed electric motor 30 is attached to the support plate 14 and arranged, through a drive means 32 that is well known in the art, to rotate the lap 20 at a selected speed. A stepper motor 40 is attached to the left most end of the base 12, as shown in FIGS. 1 and 2, and has its armature, not shown, adapted to rotate a lead screw 42 which is fixed thereto. The support plate 14 has a turned up flange 44 at one end thereof containing a threaded hole 46, the axis of which is in alignment with the direction of movement of the support plate. The lead screw 42 is in threading engagement with the threaded hole 46 so that as the stepper motor 40 rotates the lead screw in one direction or the other, the support plate 14 is made to move along the slide 16 to either the left or the right as viewed in FIGS. 1 and 2. While a stepper motor was utilized to rotate the lead screw 42, any suitable motor may be used and will function as well as the stepper motor.

A linear potentiometer 50 is attached to the base 12 by the brackets 52 as shown in FIG. 1. The wiper shaft 54 of the potentiometer 50 projects outwardly to the left, as viewed in FIG. 1, toward the support plate 14. A bracket 56 is attached to the support plate 14 and to the end 58 of the wiper shaft 54 so that as the support plate is made to move in the directions indicated by the arrows A and B, the wiper shaft will slide into or out of the linear potentiometer. The wiper shaft 54 and potentiometer 50 must be accurately aligned with the slide 16 so that any movement of the support plate 14 along the slide 16 will be accompanied by a corresponding movement of the wiper shaft within the potentiometer. In this way, movement of the support plate 14 can be electrically detected by the potentiometer 50.

A holder 60 is rigidly attached to the base 12 and includes an arm 62 which projects over the lapping surface 22. The holder 60 is arranged to hold a part 64 in lapping engagement with the lapping surface 22. Specific details of structure of the holder are particularly related to the part being lapped. Since there are numerous such structures known in the art for various types of parts that may be lapped, no particular one will be described here. It will be understood that, while the holder 60 is shown as stationary and the lap 20 as movable with respect to the base 12, the apparatus will work equally as well with the lap 20 journaled in a boss 24 that is stationary and a holder 60 that is movable.

An LED pickup 66, which will be described below, is mounted stationary with respect to the support plate 14 and in proximity to the underside 68 of the lap 20 as shown in FIG. 1. The function of the pickup 66 will be described below.

Figure 3:
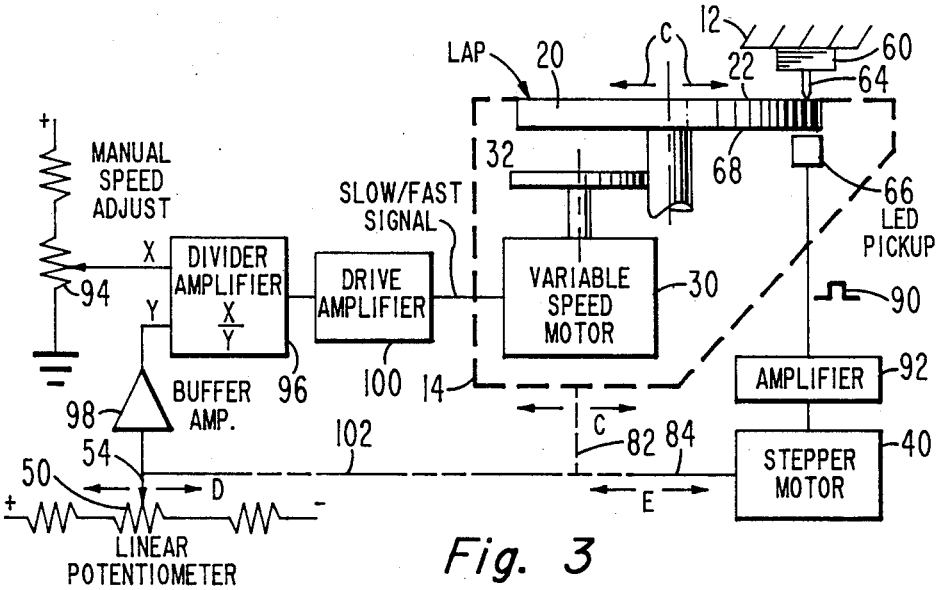
FIG. 3 is a functional block diagram of the apparatus shown in FIG. 1.

FIG. 3 is a block diagram showing both the mechanical and electrical functional relationships of the various components of the lapping apparatus 10. The dashed lines enclosing the lap 20, the variable speed motor 30, the motor drive means 32, and LED pickup 66, represent the support plate 14 which is movable in the directions indicated by the arrows C. The phantom lines 82 and 84 represent the mechanical link to the stepper motor 40 for effecting movement of the support plate 14.

The under surface 68 of the lap 20 includes a series of equally spaced strobe lines near its periphery. The LED pickup 66, which may be of the type that emits as well as receives light, is mounted in proximity to the under surface 68 so that a signal pulse 90 is generated in response to each strob line that passes the pickup 66 in a manner well known in the art. If the ambient room light is sufficient to illuminate the strobe lines then the LED pick up 66 may be of the type that only detects light. This would, of course, be a consideration should the lapping machine be enclosed in a protective enclosure. The signal 90 is input to an amplifier 92. The amplified signal is then input to the stepper motor 40 which steps one increment for each signal pulse 90 that it receives. For each such increment, the support plate 14 is advanced a finite amount that is sufficient to assure that the part 64 being laped will not contact the same area of the lapping surface 22 on two successive revolutions of the lap 20.

A manual speed adjustment in the form of a potentiometer 94 provides a scaled input to the X terminal of a divider amplifier 96. The output of the linear potentiometer 50 is applied through a buffer amplifier 98 to the Y terminal of the divider amplifier 96. The output of the divider amplifier 96 is then amplified by a drive amplifier 100 and applied directly to the variable speed motor 30 for controlling the speed thereof. The wiper shaft 54 is made to traverse the winding of the potentiometer 50 in the directions indicated by the arrows D, in FIG. 3, by the stepper motor 40 via a mechanical connection with the bracket 56 shown in FIG. 1. This mechanical connection is schematically indicated by 102 in FIG. 3.

In operation, the support plate 14 is arranged in its left most position, as viewed in FIG. 1, and the wiper shaft 54 is fully extended. This causes the output signal from the drive amplifier to drive the motor 30 at a speed that is determined by the preset manual speed adjustment 94. As the lap 20 rotates, with the part 64 in lapping engagement therewith, the LED pickup 66 will output a pulse signal 90 for each strob line detected on the undersurface of the lap. These pulse signals 90 cause the stepper motor 40 to advance the support plate 14 to the right as viewed in FIG. 1. As the support plate 14 advances, so does the wiper shaft 54 of the linear potentiometer 50 which adjusts its output signal to the Y terminal of the divider amplifier 96 so that the output signal from the divider amplifier will drive the motor 30 at an increased incremental speed corresponding to the incremental advance of the lap 20 with respect to the part 64. This correspondence is such that the part 64 will not twice encounter the same area of the rotating lapping surface 22.

As the lapping operation is completed, the finished part is retracted and another part is inserted into the holder 60 and placed into lapping engagement with the lapping surface 22. This process continues until the entire lapping surface 22 is used. The used lap is then discarded and a new one installed in its place. The support plate 14 is then retracted to its left most position, as shown in FIG. 1, and the process described above is repeated.

It will be appreciated by those skilled in the art that certain structures described above are a result of design choice and that other suitable structures may be substituted. For example, the linear potentiometer 50 may be replaced by a suitable rotary potentiometer with a suitable actuating mechanism.

One of the most important advantages realized by the present invention is assured uniformity of cutting efficiency across the entire usable lapping surface of the lap. When the present invention was tested in a production environment this uniformity of cutting was determined to be directly responsible for a substantial increase in yield from 65% of finished styli within tolerance to 92–94% within tolerance. Another important advantage realized was a doubling of the number of styli that could be lapped on a given lap from 30 to 60. In addition, the 60 styli were lapped with substantially the same elapsed time previously required to lap 30 styli.

It will be understood that these and other advantages realized in the manufacture of styli for video disc apply equally as well to the manufacture of other very small precision parts such as miniature surgical knives and tools having very small dimensions. Additionally, where crystal orientation of the part being lapped is critical, the assurance of uniform cutting efficiency across the entire usable lapping surface enables a high degree of control to be exercised over the lapping operation.

We claim:

1. An improved lapping apparatus having:

(a) a disc shaped lap journaled for rotation about an axis, said disc shaped lap having a lapping surface perpendicular to said axis;

(b) means for rotating said disc shaped lap;

(c) holder means for positioning and holding a part to be lapped in contact with said lapping surface;

(d) means for effecting movement of one of said holder means and said disc shaped lap thereby causing said holder means to track a series of substantially continuous positions with respect to said axis so that said part while in contact with said lapping surface traverses a portion thereof in either a direction toward said axis or a direction away therefrom;

the improvement comprising control means for effecting control of said means for rotating said lap so that the relative linear speed of said lapping surface with respect to said part at the point of contact with said part is substantially constant while said part traverses said portion of said lapping surface.

2. The apparatus set forth in claim 1 wherein said means for rotating said disc shaped lap is a variable speed motor and said control means comprises:

(a) means for detecting and signaling said position of said holder means with respect to said axis;

(b) means responsive to said signaling for causing said variable speed motor to operate at a predetermined speed that is related to said position of said holder means.

3. The apparatus set forth in claim 2 wherein said means for detecting and signaling comprises a potentiometer.

4. The apparatus set forth in claim 3 wherein said means responsive to said signaling comprises an amplifier.

* * * * *